US005259411A

United States Patent [19]

Guzorek

[11] Patent Number: 5,259,411

[45] Date of Patent: Nov. 9, 1993

[54] FLOW CONTROL

[75] Inventor: Steven E. Guzorek, Kinston, N.C.

[73] Assignee: The Field Controls Division of Heico, Inc., Kinston, N.C.

[21] Appl. No.: 970,102

[22] Filed: Nov. 2, 1992

[51] Int. Cl.[5] ..... F16K 15/03

[52] U.S. Cl. ..... 137/527.8; 251/338; 110/163; 126/285 R; 236/45; 454/259; 454/333; 454/359

[58] Field of Search ..... 137/527.8; 251/338; 236/45; 126/285 R, 290; 110/147, 163; 454/259, 333, 359

[56] References Cited

U.S. PATENT DOCUMENTS

| | | | |
|---|---|---|---|
| 390,761 | 10/1888 | Eareckson | 137/527.8 X |
| 944,416 | 12/1909 | Connet et al. | 137/532 |
| 1,131,065 | 3/1915 | Kuhner | 137/383 |
| 1,292,132 | 1/1919 | Stoltenberg | 236/45 |
| 1,300,685 | 4/1919 | Woodcock | 251/294 |
| 1,534,844 | 4/1925 | Fowler et al. | 251/338 X |
| 1,534,845 | 4/1925 | Fowler et al. | 137/527.8 |
| 1,775,065 | 9/1930 | Brown | 236/45 X |
| 2,246,629 | 6/1941 | Jansen | 236/45 |
| 2,259,130 | 10/1941 | Field, Jr. | 236/45 |
| 2,650,029 | 8/1953 | Field | 236/45 |
| 2,771,834 | 11/1956 | Goudy | 454/7 |
| 2,818,216 | 12/1957 | Field | 236/45 |
| 2,819,024 | 1/1958 | Field | 236/45 |
| 3,362,634 | 1/1968 | Steinen | 236/45 |
| 3,788,072 | 1/1974 | Burger | 454/2 X |
| 4,276,871 | 7/1981 | Lindtvelt | 126/292 |
| 4,369,718 | 1/1983 | Eppinger et al. | 126/292 X |
| 4,497,310 | 2/1985 | Funke | 126/292 |

*Primary Examiner*—John Rivell

*Attorney, Agent, or Firm*—Wood, Phillips, VanSanten, Hoffman & Ertel

[57] ABSTRACT

A flow control has a rotary gate residing within an internal flow space in a conduit. The gate is mounted for movement relative to the conduit between first and second positions, the gate in the first and second positions accounting for a different flow rate between first and second fluid masses between which the gate resides. The gate has an actuator with a plurality of spaced shoulders. A flexible force-applying member is connected to the actuator and bears upon the shoulders to thereby urge the gate towards the other of the first and second positions. The shoulders are situated so that the number of shoulders engaged by the force-applying member at any one time is not the same as the gate moves from the one of the first and second positions towards the other of the first and second positions.

13 Claims, 2 Drawing Sheets

FLOW CONTROL

BACKGROUND OF THE INVENTION

1. Technical Field

The present invention relates generally to a mechanism for regulating a draft in a flue, and more particularly toward a mechanism for controlling a rotary gate in a draft regulator.

2. Background Art

It is known to control a flow of gas through a conduit or flue to improve the efficiency with which combustion takes place in an associated gas burner, furnace, or the like. A rotary gate commonly is pivoted in the conduit about an off-center axis on the gate whereby a pressure differential across the gate is effective to rotate the gate and create an axial opening in the conduit for effecting a flow of gas.

Prior art devices control rotation of a gate by applying a torque to the gate in opposition to rotation induced by a pressure differential. For instance, in U.S. Pat. No. 2,650,029 to Field, issued Aug. 25, 1953 (see FIG. 1), an auxiliary weight 14 is suspended by a bead chain 17 from a control gate in a conduit 3. When the control gate 5 is rotated, the bead chain 17 wrappingly engages a cam shaped member 25 on the control gate to apply a variable torque tending to close the control gate. The closing torque varies according to the locations at which the bead chain applies force to the cam shaped member 25 and the control gate 5 relative to the axis about which the control gate rotates.

The use of a flexible member to suspend an adjustment weight from a flow regulating gate wherein the member engages an arcuate camming surface and applies a variable closing torque is shown also, for example, by Field in U.S. Pat. Nos. 2,818,216, issued Dec. 31, 1957.

A problem which exists with draft regulators of the type disclosed in the '029 and '216 patents is the difficulty and cost of manufacturing a camming member which provides desired control over the torque applied to a rotary gate. As a result, controlling the resulting relationship between the impressed (or otherwise unregulated) draft and the regulated draft is difficult.

More particularly, and as indicated previously, draft regulators which have an adjustment weight suspended by a flexible member for engaging a camming surface exert a torque which varies according to both the amount the gate is rotated and the particular shape of the camming surface. In order to provide an acceptable level of control over a draft, it is required to accurately prescribe the amount of torque which is applied to a gate over the entire range of motion of the gate. The present invention is directed toward overcoming the problem of adequately controlling a rotary gate in a draft regulator.

SUMMARY OF THE INVENTION

It is an object of the present invention, therefore, to provide a new and improved control for a rotary gate in a draft regulator.

In the exemplary embodiment, a flow control has a rotary gate residing within an internal flow space in a conduit. The gate is mounted for movement relative to the conduit between first and second positions, the gate in the first and second positions accounting for a different flow rate between first and second fluid masses between which the gate resides. The gate has an actuator with a plurality of spaced shoulders. A flexible force-applying member is connected to the actuator and bears upon the shoulders to thereby urge the gate towards the other of the first and second positions. The shoulders are situated so that the number of shoulders engaged by the force-applying member at any one time is not the same as the gate moves from the one of the first and second positions towards the other of the first and second positions.

In one aspect of the invention, the force-applying member comprises an articulated chain. One end of the chain is attached to the actuator and an adjustment weight is attached to the other end of the chain to place the chain under tension.

In another aspect of the invention, the actuator has a toothed/stepped edge with an alternating series of ridges and grooves defining the shoulders. More particularly, the toothed edge has a plurality of pairs of oppositely sloped adjacent sidewalls and the junction of the sidewalls of each pair lies on a common arc and defines one of the shoulders. The force-applying member preferably is attached to the actuator at a point which is offset from the common arc so that the gate is movable over a range in which the force-applying member does not bear upon the shoulders.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the figures and in which:

DESCRIPTION OF THE PREFERRED EMBODIMENT

Figure 2:
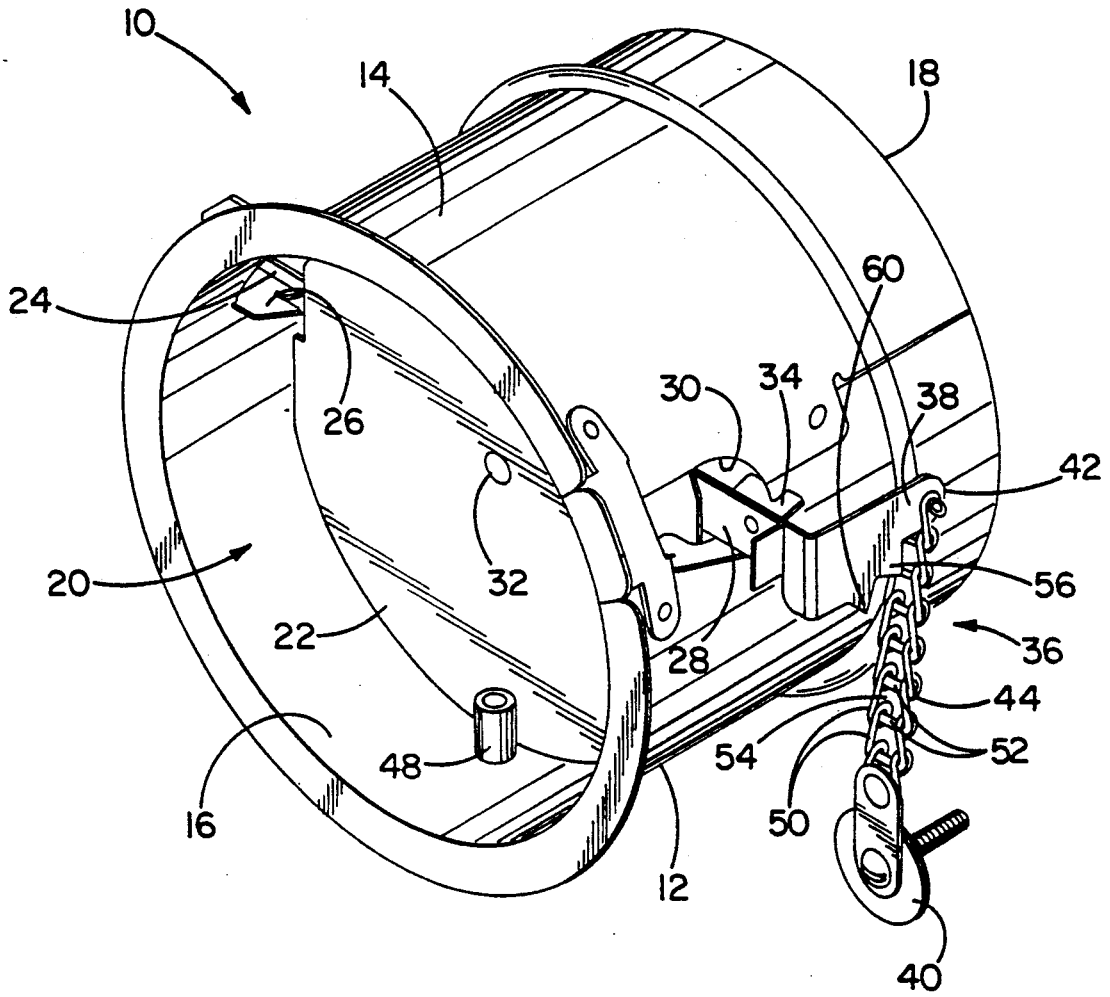
FIG. 2 is a perspective view of a draft regulator employing a rotary gate and actuator according to the present invention.

Referring to FIG. 2, an exemplary draft regulator, according to the invention, is generally designated 10 and has an elongate conduit 12. A generally cylindrical sidewall 14 on the conduit 12 extends axially between a conduit inlet 16 and a conduit outlet 18 and defines an internal flow space 20 for transporting a flow between a first fluid mass at the inlet 16 and second fluid mass at the outlet 18.

A gate 22 is mounted movably relative to the conduit 12 for regulating the rate at which fluid flows through the internal space 20. More particularly, the gate 22 is pivoted within the conduit 12 on an axle 24. Axle 24 extends transversely through the conduit 12 and is supported at one end on a generally V-shaped seat 26. A lever 28 extends from the gate 22 in axial alignment with the axle 24 and projects outwardly of the conduit through an opening 30 formed in the sidewall 14. The axle 24 and the lever 28 are arranged such that the axis about which the gate 22 is supported for rotation is offset from a center point 32 on the gate, whereby a pressure differential between the first fluid mass at the inlet 16 and the second fluid mass at the outlet 18 causes the gate 22 to rotate about the axis. Rotation of the gate 22 varies the size of an axial opening in the flow space 20 and changes the rate at which fluid moves through the conduit 12. The lever 28 has a guide 34 engaged with the sidewall 14 to guide rotation of the gate 22.

Biasing means, generally designated 36, are associated with the lever arm 28 for controlling the application of a restoring torque to the gate 22. Restoring torque opposes rotation of the gate and limits the size of the axial opening in the conduit 12 when the gate 22 is subjected to a pressure differential.

Biasing means 36 includes an actuator arm 38 integral with the lever 28. The actuator arm 38 extends axially toward outlet 18 and is rotatable in a substantially vertical plane about the axis of rotation of gate 22. An adjustment weight 40 is suspended from a distal end 42 of actuator arm 38 by means of an articulated chain 44 and thereby applies a torque tending to rotate the gate 22. In the absence of a pressure differential sufficient to overcome the torque applied by adjustment weight 40, the gate is urged into contact with a stop 48 on the conduit 12 and held in a closed position, as shown in FIG. 2.

The construction of the actuator arm 38 and the chain 44 is uniquely adapted to prescribe the relationship between the restoring torque applied by the adjustment weight 40 and the position of the gate 22 over the entire range of displacement of the gate.

Specifically, the chain 44 has a plurality of serially connected generally rectangular links 50. A cross member 52 extends transversely between each pair of adjacent links 50, and each pair of adjacent cross members 52 bound a link opening 54.

Figure 1:
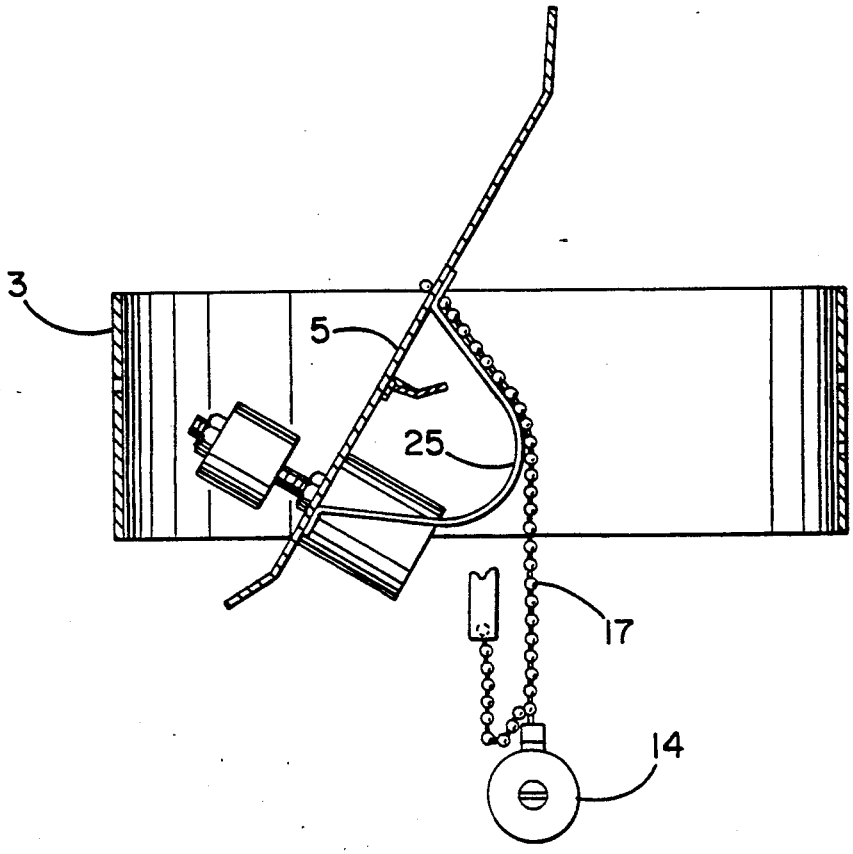
FIGURE 1 PRIOR ART
FIG. 1 is a vertical sectional view of a prior art draft regulator.
Figure 3:
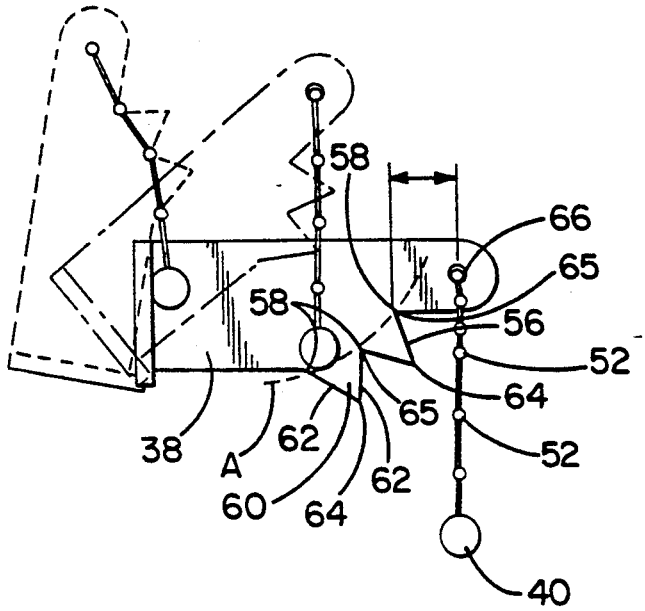
FIG. 3 is a somewhat schematic view illustrating the operation of the draft regulator shown in FIG. 2, with solid lines showing the actuator when the gate is in a closed position and dashed lines showing the actuator when the gate is in alternative open positions.

Actuator arm 38 has a toothed/stepped edge 56 consisting of a series of alternating grooves 58 and ridges 60 (see also FIG. 3). Each ridge 60 has a pair of oppositely inclined sidewalls 62 which diverge from an outer tip 64. Convergent adjacent sidewalls 62 on the toothed edge 56 define a receptacle on the actuator arm 38 for receiving a cross member 52 on one of the chain links 50 when the gate 22 is rotated. The junction of the adjacent sidewalls defines a load bearing shoulder 65 upon which the corresponding cross member 52 bears to thereby urge the gate 22 toward the closed position. Each shoulder 65 preferably lies on a common arc, represented by the line A. As shown in FIG. 3, the point 66 at which the chain 44 is connected to actuator arm 38 is offset from the common arc A.

When the gate 22 is subjected to a small differential pressure, such as during initial firing of a gas burner or furnace, the force, applied by adjustment weight 40 to connection point 66 establishes a torque sufficient to maintain the gate in a substantially closed position. Due to the offset of connection point 66 from the arc A, the chain 44 initially does not engage the toothed edge 56. As pressure begins to rise on the inlet side 16 of conduit 12, the gate 22 and the actuator arm 38 begin to rotate.

When the actuator arm rotates (as indicated in phantom lines in FIG. 3) the outer tips 64 on the ridges 60 sequentially engage a corresponding one of the link openings 54 and a cross member 52 moves inwardly into a corresponding receptacle. Continued rotation of the gate 22 and actuator arm 38 causes the cross member to bear upon the shoulder 65 whereby a portion of the weight of the adjustment weight 40 is applied to the actuator arm. In a similar manner, continued rotation of the actuator arm 38 causes the downwardly successive links 50 to sequentially engage the adjacent receptacles defined by toothed edge 56 and bear upon a respective one of the shoulders 65.

As set forth above, the present invention overcomes the problem of adequately controlling the application of torque to a rotary gate in a draft regulator by reducing the design requirements associated with suspending an adjustment weight from a lever arm on the gate. That is, the relationship between the torque and gate position easily can be prescribed by appropriate placement of the shoulders 65 on the actuator arm 38. Because force is applied only to a relative few number of discrete points when the gate and lever arm are rotated, the design task is simplified. Engagement of the toothed edge 56 by the links 52 of the chain 44 insures that force is applied only at the shoulder 65 when the gate and actuator arm are rotated. The gate torque characteristics can be modified in a predetermined fashion merely by changing the position of a single load application point. Initial firing performance of a furnace easily can be controlled by altering the offset between the adjustment weight connection point 66 and the arc A containing the load application points.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A control for regulating flow between first and second fluid masses, said control comprising:

a gate having an actuator;

means for mounting the gate to a support for movement relative to the support between first and second positions, said gate in said first and second positions accounting for a different flow rate between first and second fluid masses between which the gate resides; and means for applying a force to the actuator and for thereby normally urging the gate from one of the first and second positions towards the other of the first and second positions, said urging means including a plurality of spaced shoulders on the actuator including first and second shoulders and a force-applying member including a plurality of spaced means for bearing on the first and second shoulders to thereby urge the gate toward the other of the first and second positions, said spaced means bearing on both the first and second shoulders as the gate moves from the one of the first and second positions towards the other of the first and second positions.

2. The flow regulating control according to claim 1 in combination with a support wherein the support comprises a conduit defining an internal flow space.

3. The flow regulating control according to claim 2 wherein the gate resides at least partially within the internal flow space.

4. The flow regulating control according to claim 1 in which the force-applying member comprises a flexible line having a first end attached to the actuator and a second end to which a force is applied for placing the line in tension.

5. A control for regulating flow between first and second fluid masses, said control comprises:

a gate having an actuator;

means for mounting the gate to a support for movement relative thereto between first and second positions, said gate in said first and second positions accounting for a different flow rate between first and second fluid masses between which the gate resides; and means for applying a force to the actuator and for thereby normally urging the gate from one of the first and second positions towards the other of the first and second positions, said urging means including a plurality of spaced shoulders on the actuator and a force-applying member including a plurality of spaced means for bearing on the shoulders to thereby urge the gate toward the other of the first and second positions, wherein said shoulders are situated so that the number of shoulders engaged by the bearing means at any one time is not the same as the gate moves from the one of the first and second positions towards the other of the first and second positions.

6. A control for regulating flow between first and second fluid masses, said control comprising:

a gate having an actuator;

means for mounting the gate to a support for movement relative thereto between first and second positions, said gate in said first and second positions accounting for a different flow rate between first and second fluid masses between which the gate resides; and means for applying a force to the actuator and for thereby normally urging the gate from one of the first and second positions towards the other of the first and second positions, said urging means including a plurality of spaced shoulders on the actuator and a force-applying member including a plurality of spaced means for bearing on the shoulders to thereby urge the gate toward the other of the first and second positions, wherein said shoulders lie on a common arc.

7. A control for regulating flow between first and second fluid masses, said control comprising:

a gate having an actuator;

means for mounting the gate to a support for movement relative to the support between first and second positions, said gate in said first and second positions accounting for a different flow rate between first and second fluid masses between which the gate resides; and means for applying a force to the actuator and for thereby normally urging the gate from one of the first and second positions towards the other of the first and second positions, said urging means including a plurality of spaced shoulders on the actuator and a force-applying member including a plurality of spaced means for bearing on the shoulders to thereby urge the gate toward the other of the first and second positions, wherein said shoulders lie on a common arc, wherein the force-applying member comprises a flexible line under tension, said line being attached to the actuator at a point offset from said common arc.

8. In a control for regulating flow through an internal space in a conduit, the control having a gate which resides at least partially within the internal flow space, said gate being mounted for movement relative to the conduit between first and second positions wherein the gate accounts for a different flow rate between first and second fluid masses between which the gate resides, the improvement comprising:

an actuator for moving the gate;

a plurality of spaced shoulders on the actuator; and an articulated force-applying member for suspending a weight from the actuator, the force-applying member having a plurality of serially connected segments which sequentially bear on a corresponding one of said shoulders when the gates moves to thereby urge the gate toward the other of the first and second positions, said shoulders being situated so that the number of shoulders engaged by the force-applying member at any one time is not the same as the gate moves from the one of the first and second positions towards the other of the first and second positions.

9. The flow regulating control according to claim 8 in which the force-applying member is a chain.

10. The flow regulating control according to claim 8 in which the actuator has a corrugated edge with an alternating series of ridges and grooves defining said shoulders.

11. The flow regulating control according to claim 10 in which said corrugated edge has a plurality of pairs of oppositely sloped adjacent sidewalls, the junction of the sidewalls of one of said pairs defining one of said shoulders.

12. The flow regulating control according to claim 11 in which the junction of the sidewalls of each of said pairs of sidewalls lie along a common arc.

13. The flow regulating control according to claim 12 in which the force-applying member is attached o the actuator at a point which is offset from said common arc.

* * * * *